US006124252A

United States Patent [19]

Chavez Amaro

[11] Patent Number: 6,124,252

[45] Date of Patent: Sep. 26, 2000

[54] MULTIPURPOSE SCALE REMOVING CHEMICAL COMPOUND

[75] Inventor: Mario Alberto Chavez Amaro, Monterrey, Mexico

[73] Assignee: Lubrimak Corporation, S.A. de C.V., Monterrey, Mexico

[21] Appl. No.: 09/272,752

[22] Filed: Mar. 17, 1999

[30] Foreign Application Priority Data

Nov. 6, 1998 [MX] Mexico ..... 989251

[51] Int. Cl.[7] ..... C11D 3/22

[52] U.S. Cl. ..... 510/241; 510/180; 510/181; 510/240; 510/245; 510/257; 510/269; 134/28

[58] Field of Search ..... 134/3, 28, 15, 134/10, 22.13, 22.19, 29, 40, 41; 430/313; 510/253, 254, 421, 506, 422, 257, 241, 240, 180, 181, 269, 245

[56] References Cited

U.S. PATENT DOCUMENTS 3,847,688 11/1974 Gillice ..... 156/2
5,223,168 6/1993 Holt ..... 252/142
5,476,609 12/1995 Wilkins, Jr. et al. ..... 252/143
5,803,956 9/1998 Ohmi et al. ..... 106/1.05
5,902,411 5/1999 Williams et al. ..... 134/3

*Primary Examiner*—Yogendra Gupta
*Assistant Examiner*—Gregory E. Webb
*Attorney, Agent, or Firm*—Harrison & Egbert

[57] ABSTRACT

A multipurpose scale removal compound having a nonyl phenol ethoxylate with 10 moles of ethylene oxide at 0.85% of a total weight of the compound, hydrofluoric acid at 0.85% of the total weight of the compound, and softened water at 98.3% of the total weight of the compound. This multipurpose scale removal compound is formed by filling a reactor with 160 liters of softened water, adding 20 kilograms of hydrofluoric acid to the water in the first reactor, agitating the hydrofluoric acid and water in the first reactor, adding 20 kilograms of nonyl phenol ethoxylate with 10 moles of ethylene oxide to the first reactor, agitating the nonyl phenol ethoxylate, the ethylene oxide and the agitated hydrofluoric acid and water in the first reactor so as to obtain a uniform solution, adding 182.9 liters of softened water and 17.1 kilograms of the uniform solution to a second reactor, and agitating the softened water and uniform solution in the second reactor so as to obtain a uniform mixture.

8 Claims, No Drawings

MULTIPURPOSE SCALE REMOVING CHEMICAL COMPOUND

TECHNICAL FIELD

The present invention relates to chemicals for the removal of scale from surfaces. Additionally, the present invention relates to methods for forming such scale-removing chemical compounds.

BACKGROUND ART

At present, the cleaning and decontamination of materials, such as car and truck bodywork, tarpaulins, decorative and commercial awnings and signs, acrylic signs, glass, traffic signs and similar items, is made difficult by the large amount of new pollutants contained within the cleaning compounds. These pollutants are not easy to remove. Some of these pollutants are a consequence of acid rain, combustion residues, or minerals contained in water. For this reason, there are numerous products on the market whose function is to provide optimum cleaning. The disadvantage is that all of these products are aimed at specific materials. To date, there is no product which is multipurpose and whose use is equally effective on any surface or material.

Moreover, most of these products, besides the delicate nature of their use, require the use of a solvent such as gasoline or a thinner for their application. Their cleaning and descaling function is performed by polishing or scrubbing the surfaces to be cleaned. This requires a great deal of physical effort. In the case of an average automobile, the cleaning or descaling time for the bodywork can take from one to three hours.

Another disadvantage of existing products is that, since these products dry after application, they must be removed manually with oakum or flannel. This means that the surface of the material gets weaker and weaker, and can actually wear down so as to make it more fragile.

It is an object of the present invention to provide a multipurpose scale removing compound that does not require additional solvents for its application.

It is another object of the present invention to provide a multipurpose scale removing compound which is not abrasive.

It is a further object of the present invention to provide a multipurpose scale removing chemical compound that does not require polishing or scrubbing in order to achieve the results.

It is a further object of the present invention to provide a multipurpose scale removing chemical compound which minimizes the amount of physical effort required for its application.

It is still another object of the present invention to provide a multipurpose scale removing chemical compound which does not have to be removed with oakum or flannel.

It is a further object of the present invention to provide a multipurpose scale removing chemical compound which is not flammable.

It is still a further object of the present invention to provide a multipurpose scale removing chemical compound that can be used on delicate surfaces that cannot be polished or scrubbed.

It is still another object of the present invention to provide a multipurpose scale removing chemical compound that does not give off unpleasant fumes or smells.

It is still another object of the present invention to provide a multipurpose scale removing chemical compound that is in a liquid and easily rinsable.

These and other objects and advantages of the present invention will become apparent from a reading of the attached specification and appended claims.

SUMMARY OF THE INVENTION

The present invention is a multipurpose scale removal compound comprising a nonyl phenol ethoxylate compound having ten moles of ethylene oxide at 0.85% of a total weight of the compound, hydrofluoric acid at 0.85% of the total weight of the compound, and softened water at 98.3% of the total weight of the compound.

The present invention is also a method of forming the multipurpose scale removal compound comprising the steps of: (1) filling a first reactor with 160 liters of softened water; (2) adding 20 kilograms of hydrofluoric acid to the water in the first reactor; (3) agitating the hydrofluoric acid and water in the first reactor; (4) adding 20 kilograms of nonyl phenol ethoxylate with 10 moles of ethylene oxide to the first reactor; (5) agitating the nonyl phenol ethoxylate, the ethylene oxide and the agitated hydrofluoric acid and water in the first reactor so as to obtain a uniform solution; (6) adding 182.9 liters of softened water and 17.1 kilograms of the uniform solution to a second reactor; and (7) agitating the softened water and the uniform solution in the second reactor so as to obtain a uniform mixture. Each of the first and second reactors has a 200 liter capacity. The steps of agitating occur for a period of one minute. The uniform solution from the second reactor is bottled.

The uniform solution can be applied to the surface to be cleaned. This solution is applied to the surface for a period of between 30 seconds and two minutes. The applied solution can then be rinsed with water from the surface. The solution can be applied by a compressed air atomizer or by spraying the bottled uniform solution onto the surface.

DETAILED DESCRIPTION OF THE PRESENT INVENTION

The formula and the manufacturing process of our MULTIPURPOSE SCALE REMOVING CHEMICAL COMPOUND, which has two stages, is detailed below:

| Formula: | % in weight |
|---|---|
| Nonyl Phenol Ethoxylate with 10 moles of Ethylene Oxide | 0.85 |
| Hydrafluoric Acid (HF) | 0.85 |
| Softened Water (H20) | 98.3 |

The manufacturing process is as follows:

First stage:

a) Fill a 200 liter capacity reactor with 160 liters of softened water ($H_2O$).

b) Weigh out 20 kilograms of hydrofluoric acid (HF) and add to the reactor containing the water. Agitate for one minute.

c) Weigh out 20 kilograms of nonyl phenol ethoxylate with 10 moles of ethylene oxide and add to the reactor.

d) Agitate until a uniform solution is obtained.

Second stage:

e) Fill a 200 liter capacity reactor with 182.9 liters of softened water ($H_2O$).

f) Add 17.1 kilograms of the solution obtained in the first stage to the reactor.

g) Agitate for one minute until a uniform solution is obtained.

h) Bottle the solution.

This formula must be applied according to the following instructions for use:

The product is applied with a compressed air atomizer or spray directly to the surface to be cleaned or de-scaled.

Leave for 30 seconds to 2 minutes, depending on the amount of scale or dirt found on the surface to be cleaned.

Rinse off with water.

The advantages of this invention are that, in contrast with the other products of this type, it does not require additional solvents for its application, nor is it abrasive, therefore, it is not necessary to polish or scrub to achieve the results. Consequently, physical effort is not required for its application, and moreover, it is rinsed off simply with water, without having to scrub it off with oakum or flannel. Due to the lack of additional solvents, it is not flammable; its action time is up to 30 times less than that of existing products; it can be used on delicate surfaces that cannot be polished or scrubbed, such as decorative awnings or panoramic signs, etc.; it does not give off unpleasant fumes or smells; and it comes in a liquid form, therefore it is easily rinsed.

The foregoing disclosure and description of the invention is illustrative and explanatory thereof. Various changes in the details of the described formula or in the steps of the described method can be made within the scope of the appended claims without departing from the true spirit of the invention. The present invention should only be limited by the following claims and their legal equivalents.

I claim:

1. A method for forming a multi-purpose scale removal compound comprising:

filling a first reactor with 160 liters of softened water;

adding 20 kilograms of hydrofluoric acid to the water in the first reactor;

agitating the hydroflouric acid and water in the first reactor;

adding 20 kilograms of nonyl phenol ethoxylate with 10 moles of ethylene oxide to the first reactor;

agitating the nonyl phenol ethoxylate, the ethylene oxide and the agitated hydrofluoric acid and water in the first reactor so as to obtain a uniform solution;

adding 182.9 liters of softened water and 17.1 kilograms of said uniform solution to a second reactor; and agitating the softened water and uniform solution.

2. The method of claim 1, each of said first and second reactors having a 200 liter capacity.

3. The method of claim 1, said step of agitating the hydrofluoric acid and water in the first reactor being for a period of one minute.

4. The method of claim 2, said step of agitating the softened water and uniform solution being for a period of one minute.

5. The method of claim 1, further comprising the step of:

bottling said uniform solution from said second reactor.

6. The method of claim 1, further comprising the step of:

applying the bottled uniform solution onto a surface to be cleaned;

leaving the applied solutions on the surface for a period of between 30 seconds to 2 minutes; rinsing the applied solution with water from the surface following the step of leaving.

7. The method of claim 6, said step of applying being by a compressed air atomizer.

8. The method of claim 6, said step of applying comprising:

spraying the bottled uniform solution onto the surface to be cleaned.

* * * * *